US007549690B2

(12) United States Patent
Bourgraf et al.

(10) Patent No.: US 7,549,690 B2
(45) Date of Patent: Jun. 23, 2009

(54) ARRESTING DEVICE OF A COT FASTENING SYSTEM

(75) Inventors: El-B Bourgraf, Maineville, OH (US); Abe Arnold, Sabina, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 2 days.

(21) Appl. No.: 11/834,150

(22) Filed: Aug. 6, 2007

(65) Prior Publication Data

US 2008/0034496 A1 Feb. 14, 2008

Related U.S. Application Data

(60) Provisional application No. 60/837,333, filed on Aug. 11, 2006.

(51) Int. Cl.
*A61G 1/02* (2006.01)

(52) U.S. Cl. ..... 296/20; 296/65.04; 410/7; 410/80

(58) Field of Classification Search ..... 296/20, 296/65.04; 410/3, 4, 7, 80
See application file for complete search history.

(56) References Cited

U.S. PATENT DOCUMENTS 618,507 A * 1/1899 Henderson et al. ..... 211/5
1,477,815 A 12/1923 Denning
2,303,618 A 12/1942 Couleur
3,005,656 A 10/1961 Fulton
3,221,907 A 12/1965 O'Sullivan
3,425,517 A 2/1969 Speir
3,918,554 A 11/1975 Bourgraf et al.
4,690,364 A * 9/1987 Constantin ..... 248/503.1
4,957,121 A 9/1990 Icenogle et al.
5,092,722 A 3/1992 Reazer, III et al.
5,913,559 A 6/1999 Sexton et al.
6,331,094 B1 * 12/2001 Burrows ..... 410/30
6,796,757 B1 9/2004 Way et al.
2006/0131909 A1 6/2006 Bourgraf, Jr. et al.

* cited by examiner

*Primary Examiner*—Dennis H Pedder
(74) *Attorney, Agent, or Firm*—Dinsmore & Shohl LLP

(57) ABSTRACT

An arresting device used in a cot fastening system for an emergency vehicle is disclosed. The arresting device includes an extension beam providing a bolt pattern, and a pair of antler brackets each having first and second hook portions. The present invention may be used with a plurality of prior art cots, without requiring modifications or installation changes to the emergency vehicle or the cot fastening system to which the arresting device is a part thereof.

20 Claims, 4 Drawing Sheets

ARRESTING DEVICE OF A COT FASTENING SYSTEM

CROSS-REFERENCE TO RELATED APPLICATIONS

This application claims the benefit of U.S. Provisional Application Ser. No. 60/837,333, filed Aug. 11, 2006.

FIELD OF THE INVENTION

The present invention relates to cot fastening systems and in particular, to a floor-mounted arresting device of the antler type used in a cot fastening system for an emergency vehicle.

BACKGROUND OF THE INVENTION

In ambulances and other emergency/rescue vehicles, removable, wheeled cots or stretchers are often provided for convenient and comfortable patient transportation from a remote accident site to the emergency vehicle. These cots or stretchers are often referred to as "roll-in" devices, and generally feature a plurality of wheels for inserting and removing the cot from the emergency vehicle, as well as an adjustable or multi-level fold down carriage supporting a set of wheels which enables the cot to be easily rolled along sidewalks, roads, or other access surfaces.

The mobile patient transportation cots or similar devices commonly include a structural frame, which is often tubular in nature, to provide lightweight support for the patient and the wheels, casters or other rolling mechanisms attached thereto. Once the patient is rolled to the emergency vehicle on the cot, the undercarriage may be collapsed and folded under the cot to facilitate insertion of the cot into the emergency vehicle. The cot is then rolled into the emergency vehicle and fastened into position for safe transportation.

A prior art cot fastening system 10 is illustrated by FIG. 1. The cot fastening system comprising a front arresting device 20, and a separate rear fastening device or locking bar 30. The front arresting device 20 is used to secure the front wheels of the cot and the locking bar 30 is used to secure the cot frame. Such a cot fastening system has been widely used in the industry for a number of years. As shown in FIG. 2, the front arresting device, often referred to generally as the "antlers," includes a bracket with a pair of upwardly, extending hook-like members 40, which curve to the rear of the emergency vehicle 45 and are designed to receive and effectively hook onto portions of the forward support frame members 50 of the cot 60, as shown in FIG. 2. This antler bracket 20 thereby limits forward movement of the cot within the emergency vehicle. The rear locking bar 30 is thereafter secured to the cot frame to secure the cot against further rolling movement within the emergency vehicle.

While such cot fastening systems have been widely and successfully used, there are a plurality of designs for cots and other wheeled devices utilized in various emergency vehicles and the like, and interchangeable use of prior cot fastening systems often required modification of the fastening system itself or its installation, or adjustments to the system. In particular, prior art fastening system all use different mounting assemblies which depends on the particulars of the cot in use.

For example, prior art antler brackets require alternate antler bracket mounting locations in the floor of the emergency vehicle for the various types of cots, such as for example, the Model 30 and 35 series Ferno brand cots. Often, this requires installation of an additional mounting plate in the floor of the emergency vehicle if desiring to interchange one cot with another. However, when multiple emergency vehicles containing various types of cot fastening systems respond to an emergency, delays in removing patients from the scene may result due to the lack of interoperability, as particular cot must be match up with particular fastening systems.

This problem is further acerbated by the fact that from a regulation standpoint, some ambulance manufacturers must provide the floor cot mounting hardware (mount, locking bar, and antler bracket) that matches the cot being used (i.e., a Ferno brand cot must have Ferno brand floor hardware installed). Should an end user be considering a cot change or addition while at the same time ordering a new ambulance, the cot decision must be made before the mounts are installed in the new ambulance. Accordingly, a cot fastening system which accommodates a broader range of cot models and which automatically and dependably accepts and functions properly with those various models without modification or adjustment to the ambulance or cot fastening system to which the arresting device is a part thereof, is still a desire in the industry in order to reduce the number of issues regarding interoperability.

SUMMARY OF THE INVENTION

It is against the above background that the present invention provides improvements and advancements over the prior art. In particular, the present invention is an improved floor mounted arresting device for a cot fastening system that accepts a plurality of cots and devices of differing designs, without requiring modifications or installation changes to the ambulance or the cot fastening system to which the arresting device is a part thereof.

In one embodiment, an arresting device used in a cot fastening system of an emergency vehicle is disclosed. The arresting device comprises a pair of antler brackets each having first and second hook portions. The first hook portion have an orientation different from the second hook portion.

In another embodiment, an arresting device used in a cot fastening system of an emergency vehicle is disclosed. The arresting device comprises a pair of antler brackets each having first and second hook portions. The first hook portion have an orientation different from the second hook portion. A first bolting mount is also provided. The antler brackets are secured to the first bolting mount. A pair of first extension braces each having a first end secured between the first and second hook portions of a respective one of the antler brackets is provided. A pair of second extension braces each having a first end secured between the first hook portion and the first bolting mount of a respective one of the antlers brackets is also provided.

In still another embodiment, an arresting device used in a cot fastening system of an emergency vehicle is disclosed. The arresting device comprises a pair of antler brackets each having first and second hook portions. The first hook portion has a horizontal orientation, and the second hook portion has a vertical orientation. A first bolting mount is provided. The antler brackets are secured to the first bolting mount. A pair of first extension braces each having a first end secured between the first and second hook portions of a respective one of the antler brackets is also provided as well as a pair of second extension braces each having a first end secured between the first hook portion and the first bolting mount of a respective one of the antlers brackets. A second bolting mount is also provided, wherein second ends of each of the first and second extension braces are secured to the second bolting mount. In addition, the first and second bolting mounts each provide a removable fastener configured to releaseably engage a floor of the emergency vehicle. Portions of the antler brackets and the second extension braces are configured to lie in a plane parallel to the floor of the emergency vehicle.

These and other features and advantages of the invention will be more fully understood from the following description of an embodiment of the invention taken together with the accompanying drawings.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION OF THE INVENTION

Figure 3:
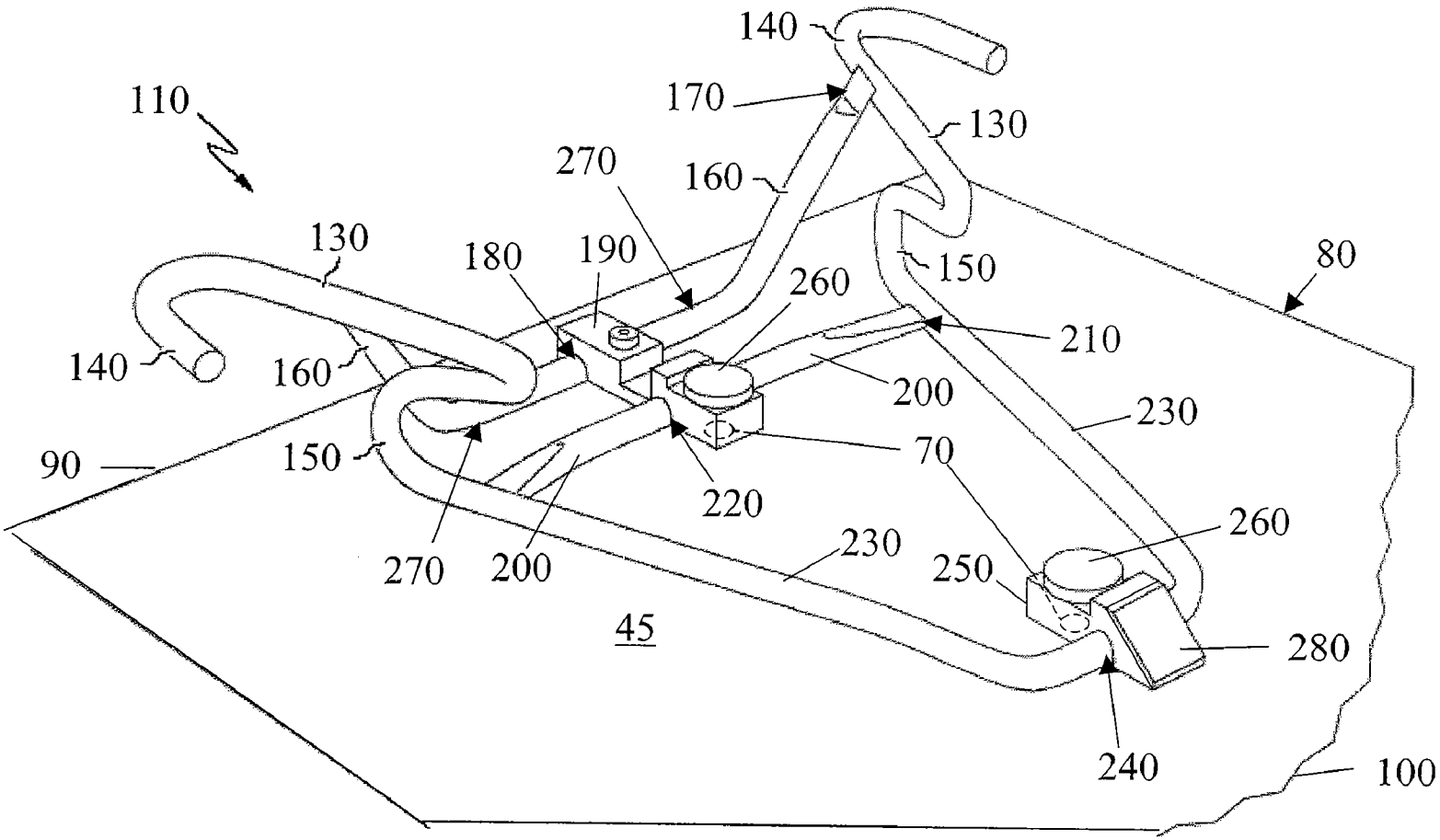
FIG. 3 is an elevated perspective view of an arresting device of a cot fastening system of the present invention.

Referring now to the drawings in detail, wherein like numerals indicate the same elements throughout the views, FIG. 3 illustrates a perspective view of the rear transport portions of an emergency vehicle 80, having a forward end 90 and rear end 100, into which a wheeled cot, stretcher, or similar patient transfer device is to be placed. While the present invention is applicable to nearly any wheeled device having a support frame and which is to be secured along a substantially planar surface, the present invention will be shown and described in relation to one specific application of the invention wherein a wheeled emergency cot is to be secured along the floor 45 of the emergency vehicle 80 by an arresting device 110 according to the present invention.

The term "cot" will be understood to refer to any of a variety of patient transfer devices, stretchers, carts or incubator transporters commonly known and utilized in the industry (e.g. Model 26 Series, Model 28 Series, Model 29-M, Model 30 Series, Models 35-A, 35-A+, and 35-P ProFlexx, Models 93ES and 93EX, XCalibur Cots, etc., such as available from Ferno-Washington, Inc. of Wilmington, Ohio). Such cots often have a pair of front loading wheels to facilitate insertion and removal of the device from an emergency vehicle, as well as a rear fold-down wheel assembly, including a plurality of wheels to facilitate rolling movement of the cot between the emergency vehicle and other locations. While the cots illustrated and described herein are contemplated as including wheels to facilitate movement of the cot along a planar surface, such wheels could be substituted by other devices such as slides, rollers, skis or the like.

Figure 4:
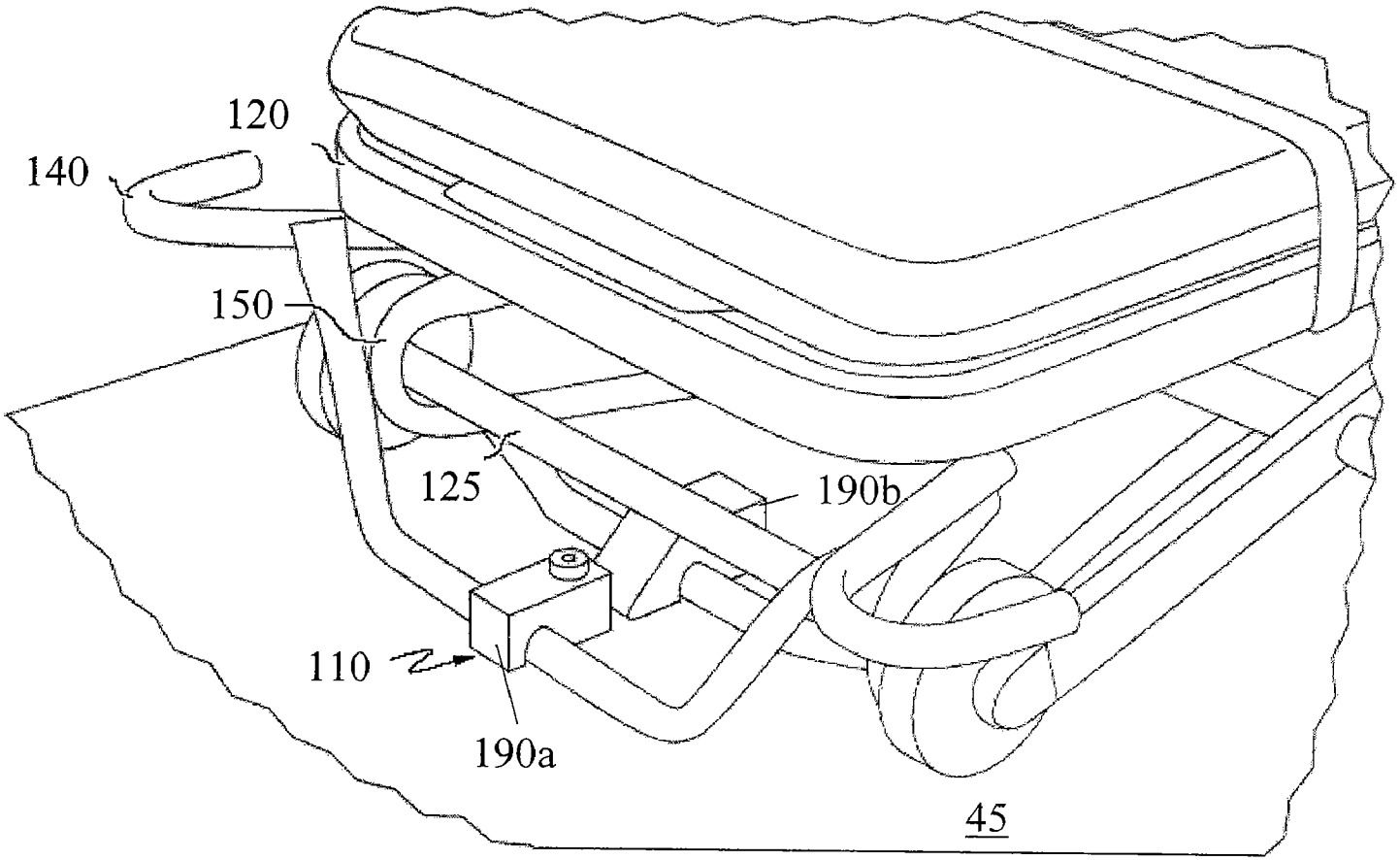
FIG. 4 is an elevated perspective view of the arresting device of FIG. 3 depicted being used to secure a prior art cot.

The arresting device 110 as shown in FIGS. 3-4 fits the conventional mount spacing or bolt pattern 70 provided to the floor 45 of the emergency vehicle 80, and is illustrated in dashed lines in FIG. 3. The conventional bolt pattern 70 would be the same bolt pattern used to secure the conventional device 20 shown FIG. 2 to the floor 45. The arresting device 110 is provided with a pair of antler bracket portions 130, each having a first hook portion 140, and a second hook portion 150. The first and second hook portions 140, 150 are shaped and sized to engage a forward portion of a cot when situated in the emergency vehicle 80. For example, the cot 60 in FIG. 1 may be a Ferno Model 35 Cot, while the cot 120 depicted in FIG. 4 may be a Ferno Model 28 Cot Chair. It is to be appreciated that the arresting device 110 of the present invention is suitable to releasably hold both such cots 60 and 120.

The first hook portions 140 have a first orientation, and the second hook portion 150 have a second orientation, which is different from the first orientation. In one embodiment, the first orientation situates the first hook portions 140 in a substantially horizontal position. In one embodiment, the second orientation situates the second hook portions 150 in a substantially vertical position. In still another embodiment, the first orientation situates the first hook portions 140 in a substantially horizontal position, and the second orientation situates the second hook portions 150 in a substantially vertical position.

Each of the pair of antler brackets 130 has a respective first extension brace 160. Each extension brace 160 has a first end 170 secured between the first and second hook portions 140, 150, and a second end 180 provided to a forward bolting mount 190. The forward bolting mount 190 in one embodiment is a unity piece such illustrated in FIG. 3, and in another embodiment is two pieces 190*a*, 190*b* as depicted in FIG. 4. A second extension brace 200 is also provided to each of the antler brackets 130. Each second extension brace 200 has a first end 210 secured forward of the second hook portion 150 and a second end 220 provided to the forward bolting mount 190.

In one embodiment, the first extension braces 160 are a unity piece passing through the forward bolting mount 190. In another embodiment, the first extension braces 160 are individual pieces having the second ends 180 mounted to sides of the forward bolting mount 190. In another embodiment, the second ends 180 are mounted to sides of the first piece 190*a* of the forward bolting mount 190 as shown by FIG. 4

In one embodiment, the second extension braces 200 are a unity piece passing through the forward bolting mount 190. In a second embodiment, the second extension braces 200 are individual pieces having second ends 220 mounted to sides of the forward bolting mount 190. In another embodiment, the second ends 220 are mounted to sides of the second piece 190*b* of the forward bolting mount 190 as shown by FIG. 4.

The antler brackets 130 further include elongated bracket portions 230 which each have a first end 240 which are provided to a rearward bolting mount 250. The elongated bracket portions 230 lie in a plane substantially parallel to the floor 45 of the emergency vehicle when the arresting device 110 is bolted to the floor 45 via removable fasteners 260 engaging the bolting pattern 70. Removable fasteners 260 are provided to releasably mount the arresting device 110 to the floor 45 of the emergency vehicle 80. In one embodiment, the removable fasteners 260 are knurled knob threaded bolts. In another embodiment, any other type of device(s) to releasably mount the arresting device 110 to the floor 45 of the emergency vehicle 80 may be used.

In one embodiment, the antler brackets 130 are a unity piece passing though the rearward bolting mount 250, and in a second embodiment, are individual pieces having the first ends 240 mounted to sides of the rearward bolting mount 250.

In one embodiment, the second extension braces 200 lie substantially in the same plane as the elongated bracket portions 230. In another embodiment, a portion 270 of each the first extension braces 160 lie substantially in the same plane as the elongated bracket portions 230. In still another embodiment, the portions of the first extension braces 160 and the second extension braces 200 lie substantially in the same plane as the elongated bracket portions 230. Providing the elongated bracket portions 230 and the second extension braces 200 in the above described manner permits a cot, such as cot 120 in FIG. 4, to roll over such portions and braces without interference such that the second hook portions 150 of the antler bracket engage a horizontally extending frame member 125 of the cot.

Figure 2:
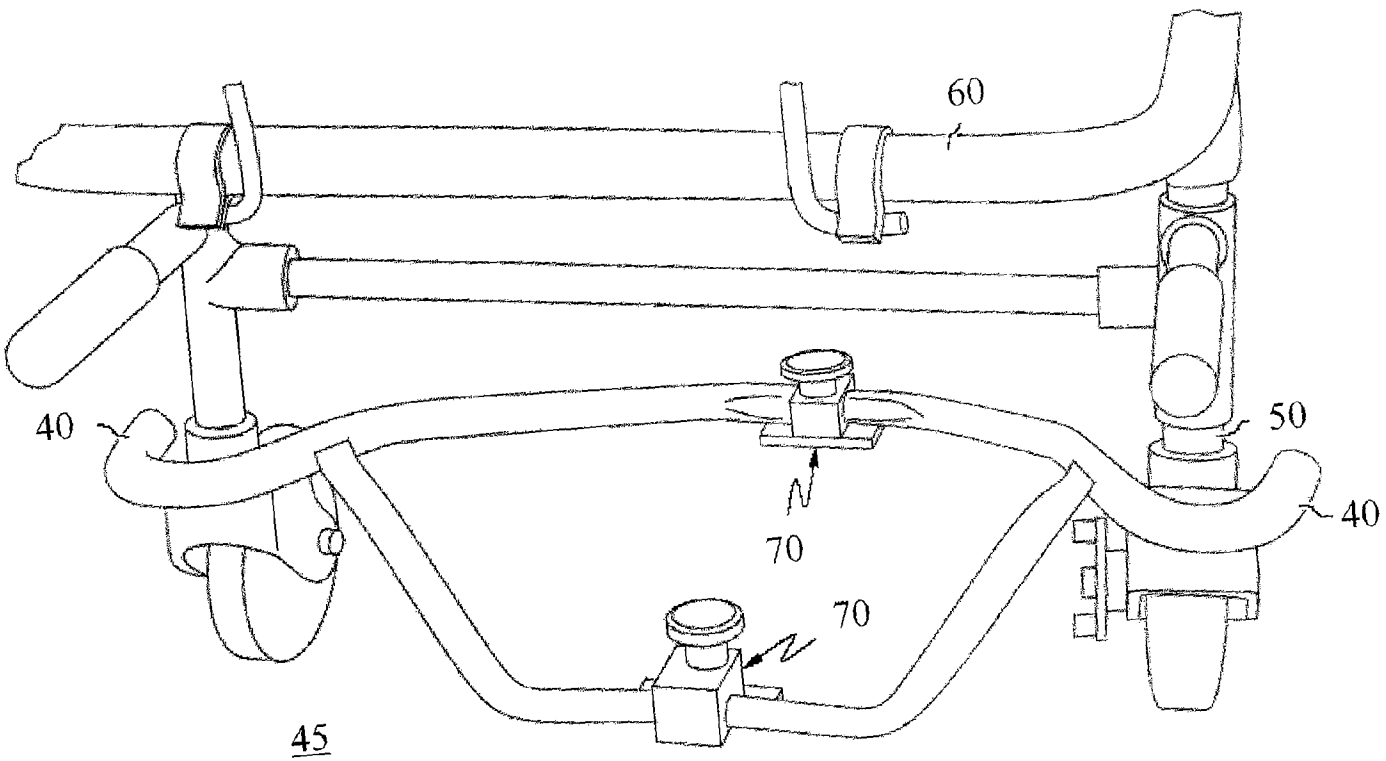
FIG. 2 (Prior Art)
FIG. 2 is a front perspective view of a prior art cot fastening system, showing the antler bracket holding the loading end of an cot.

It is to be appreciated that the first hook portions 140 are used to engage a downwardly extending forward support frame members, such as members 50 of cot 60 illustrated in FIG. 2. By virtue of providing the first and second hook portions 140, 150 of the antler brackets 130, no modification to the floor 45 of the emergency vehicle 80 or other components of the cot fastening system to which the arresting device 110 is a part thereof, is required to accommodate a wider range of prior art cots.

In one embodiment, the arresting device 110 is metal. In other embodiments, the arresting device 110 may be any other suitable material sufficient to firmly hold a cot during an impact, such as during a crash of the emergency vehicle 80. The arresting device 110 may also includes a polymer bump guard 280, which is mounted to the rearward bolting mount 250.

Figure 1:
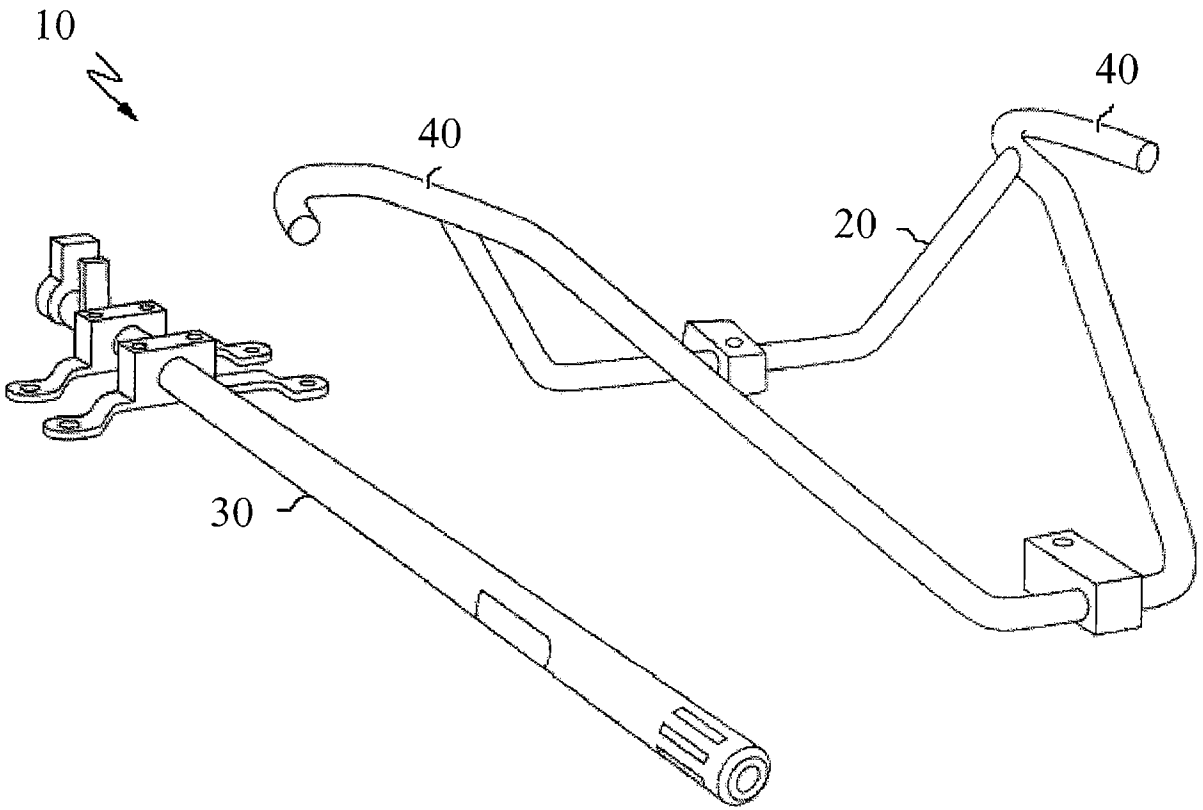
FIG. 1 (Prior Art)
FIG. 1 is an elevated perspective view of a prior art cot fastening system.

A conventional and separate rear-fastening rail is also provided in conjunction with the arresting device 110 to secure the cot against rolling movement within the emergency vehicle. Together, the arresting device 110 and rear-fastening rail form a cot fastening system. One suitable rear-fastening rail 30 is shown in FIG. 1. As this rear fastening rail 30 is conventional, no further discussion is provided.

It will be apparent to those skilled in the art that various changes may be made without departing from the scope of the invention which is not considered limited to what is described in the specification. Accordingly, it is intended that the invention not be limited to the disclosed embodiments, but that it have the full scope permitted by the language of the following claims.

What is claimed is:

1. An arresting device used in a cot fastening system of an emergency vehicle which transports a cot, said arresting device comprising a pair of antler brackets each having first and second hook portions, said first hook portion being above the second hook portion and having a free end and an orientation for engaging the cot in a plane different from said second hook portion, and said arresting device being configured to releasably hold a forward portion of the cot when situated in the emergency vehicle via one of the first and second hook portions of each antler bracket engaging a member of the cot that is transverse to the orientation of the engaging hook portions.

2. The arresting device of claim 1 further comprising removable fasteners configured to releasably engage the emergency vehicle.

3. The arresting device of claim 1, further comprising a bolting mount, said antler brackets being secured to said bolting mount.

4. The arresting device of claim 1, wherein each of said pair of antler brackets has a respective pair of extension braces.

5. The arresting device of claim 1, wherein each of said pair of antler brackets has a respective extension brace having a first end mounted between said first and second hook portions.

6. The arresting device of claim 1, further comprising a bolting mount, said antler brackets being secured to said bolting mount, wherein each of said pair of antler brackets has a respective first extension brace having a first end mounted between said first and second hook portions, and a respective second extension brace having a first end mounted between said first hook portion and said bolting mount.

7. The arresting device of claim 1, further comprising first and second bolting mounts, said antler brackets being secured to said second bolting mount, wherein each of said pair of antler brackets has a respective first extension brace having a first end mounted between said first and second hook portions, a respective second extension brace having a first end mounted between said first hook portion and said second bolting mount, wherein second ends of said first and second extension braces are mounted to said first bolting mount.

8. The arresting device of claim 1, further comprising first and second bolting mounts, said antler brackets being secured to said second bolting mount, wherein each of said pair of antler brackets has a respective first extension brace having a first end mounted between said first and second hook portions, a respective second extension brace having a first end mounted between said first hook portion and said second bolting mount, wherein second ends of said first and second extension braces are mounted to said first bolting mount, and said first and second bolting mounts provide fastening devices which are configured to engage with a bolt pattern of the emergency vehicle.

9. The arresting device of claim 1, further comprising first and second bolting mounts, said antler brackets being secured to said second bolting mount, wherein each of said pair of antler brackets has a respective first extension brace having a first end mounted between said first and second hook portions, a respective second extension brace having a first end mounted between said first hook portion and said second bolting mount, wherein second ends of said first and second extension braces are mounted to said first bolting mount, and said second extension brace is configured to lie in a plane parallel to a floor of the emergency vehicle.

10. The arresting device of claim 1, further comprising first and second bolting mounts, said antler brackets being secured to said second bolting mount, wherein each of said pair of antler brackets has a respective first extension brace having a first end mounted between said first and second hook portions, a respective second extension brace having a first end mounted between said first hook portion and said second bolting mount, wherein second ends of said first and second extension braces are mounted to said first bolting mount, and portions of said antler brackets and said second extension brace are configured to lie in a plane parallel to a floor of the emergency vehicle.

11. The arresting device of claim 1, further comprising a bolting mount, said antler brackets being secured to said bolting mount having a bump guard.

12. The arresting device of claim 1 forming part of an cot fastening system comprising a rear-fastening rail.

13. An arresting device used in a cot fastening system of an emergency vehicle which transports a cot, said arresting device comprising:

a pair of antler brackets each having first and second hook portions, said first hook portion being above the second hook portion and having a free end and an orientation in a plane different from said second hook portion;

a bolting mount, said antler brackets being secured to said bolting mount;

a pair of first extension braces each having a first end secured between said first and second hook portions of a respective one of said antler brackets; and a pair of second extension braces each having a first end secured adjacent said first hook portion of a respective one of said antlers brackets, wherein said arresting device is configured to releasably hold a forward portion of the cot when situated in the emergency vehicle via one of the first and second hook portions of each antler bracket engaging a member of the cot that is transverse to the orientation of the engaging hook portions.

14. The arresting device of claim 13 further comprising an additional bolting mount, wherein second ends of each of said first and second extension braces are mounted to said additional bolting mount.

15. The arresting device of claim 13, wherein portions of said antler brackets and said second extension braces are configured to lie in a plane parallel to a floor of the emergency vehicle.

16. The arresting device of claim 13, wherein said bolting mount provides a removable fastener configured to releasably engage the emergency vehicle.

17. The arresting device of claim 13 further comprising an additional bolting mount, wherein second ends of each of said first and second extension braces are mounted to said additional bolting mount, wherein said bolting mounts each provide a removable fastener configured to releasably engage the emergency vehicle.

18. The arresting device of claim 13 wherein said antler brackets are a unitary piece, said first extension braces are a unitary piece, and said second extension braces are a unitary piece.

19. The arresting device of claim 13 forming part of an cot fastening system comprising a rear-fastening rail.

20. An arresting device used in a cot fastening system of an emergency vehicle which transports a cot, said arresting device comprising:

a pair of antler brackets each having first and second hook portions, said first hook portion being above said second hook portion and having a free end and a horizontal orientation, and said second hook portion having a vertical orientation;

a bolting mount, said antler brackets being secured to said bolting mount;

a pair of first extension braces each having a first end secured between said first and second hook portions of a respective one, of said antler brackets;

a pair of second extension braces each having a first end secured between said first hook portion and said bolting mount of a respective one of said antlers brackets;

an additional bolting mount, wherein second ends of each of said first and second extension braces are secured to said additional bolting mount, wherein said bolting mounts each provide a removable fastener configured to releasably engage a floor of the emergency vehicle, wherein portions of said antler brackets and said second extension braces are configured to lie in a plane parallel to the floor of the emergency vehicle, wherein said arresting device is configured to releasably hold a forward portion of the cot when situated in the emergency vehicle via either the first hook portion of each antler bracket engaging a vertically extending member of the cot or the second hook portion of each antler bracket engaging a horizontally extending member of the cot.

* * * * *